United States Patent [19]

Lai et al.

[11] Patent Number: 4,984,141

[45] Date of Patent: Jan. 8, 1991

[54] WARNING AND LIGHTING FLASH LIGHT

[75] Inventors: Larry Lai; Zong-Syh Lai; Der-Shen Lai, all of ChiaYi Hsien, Taiwan

[73] Assignee: Plum Industrial Co., Ltd., ChiaYi Hsien, Taiwan

[21] Appl. No.: 479,671

[22] Filed: Feb. 15, 1990

[51] Int. Cl.[5] ..... F21L 15/02

[52] U.S. Cl. ..... 362/187; 362/206

[58] Field of Search ..... 362/187, 202, 206, 208

[56] References Cited

U.S. PATENT DOCUMENTS

| | | | |
|---|---|---|---|
| 2,119,486 | 5/1938 | Muldoon | 362/202 |
| 2,225,936 | 12/1940 | Williams | 362/206 |
| 2,855,499 | 10/1958 | Lewis | 362/202 |
| 3,835,272 | 9/1974 | Wisenbaker | 362/206 |
| 3,877,171 | 4/1975 | Sloop et al. | 362/202 |
| 4,307,439 | 12/1981 | Sassmannshausen | 362/202 |
| 4,609,976 | 9/1986 | Geissler | 362/202 |

FOREIGN PATENT DOCUMENTS

| | | | |
|---|---|---|---|
| 898236 | 6/1962 | United Kingdom | 362/202 |

*Primary Examiner*—Ira S. Lazarus
*Assistant Examiner*—Richard R. Cole
*Attorney, Agent, or Firm*—Larson & Taylor

[57] ABSTRACT

A warning & lighting flash light has a cylindrical tube, a rear lid and a front cap which can adjustably be rotated around the tube to move back and forth in such a distance to make the light of the lamp to be reflected forward by the mirror provided at the front cap to function as a lighting flash light or to shoot through the light passing portion covered with a filter to function as a warning one.

2 Claims, 3 Drawing Sheets

WARNING AND LIGHTING FLASH LIGHT

BACKGROUND OF THE INVENTION

A common warning flash light for directing traffic has a red-colored filter to attract attention, but can hardly be used for lighting at the same time. And a common flash light can only be used for lighting, not for warning.

SUMMARY OF THE INVENTION

This invention has been devised to furnish a flash light possible to be used for both purposes by means of a front cap adjustably screwing with the front end of the flash light body to alter its function for lighting into that for warning, or vice versa.

The warning & lighting flash light in the present invention comprises a cylindrical tube, a front cap and a rear lid as the main components.

The cylindrical tube is to contain dry cells and provided with a front end having a male-threaded portion for a female-threaded portion of the front cap to adjustably screw with and a female-threaded portion for a lamp to screw with, and with a rear end having a female-threaded portion to screw with a smaller diameter male-threaded portion of the rear lid.

The front cap is also cylindrical and provided with a female-threaded portion to adjustably screw around with the male-threaded portion of the front end of the tube, a cone-shaped reflective mirror in the interior having a central hole, and a circumferential light passing portion covered with a colored filter at the middle section. When the front cap is screwed around the tube deeply enough to make the lamp extending through the central hole in the mirror, the light of the lamp can be reflected to shoot forward by the mirror, making this flash light function as a lighting one. When the front cap is screwed around the tube shallowly to make the lamp located behind the mirror, the light of the lamp can only shoot through the light passing portion covered with the colored filter of the cap, making this flash light function as a warning one.

The rear lid of metal is provided with a smaller diameter male-threaded portion to screw with an inconductive female-threaded portion of the rear end of the tube, and a hollow interior for a metal spring to fit in to urge dry cells conducting the electric current to the rear lid. The rear lid can be adjustably screwed with the tube so that a gap can be formed between the rear lid and the tube to make the rear lid function as a switch to turn on or off the lamp.

BRIEF DESCRIPTION OF THE DRAWINGS

This invention will now be described in detail with reference to accompanying drawings wherein.

DETAILED DESCRIPTION OF THE INVENTION

Figure 1:
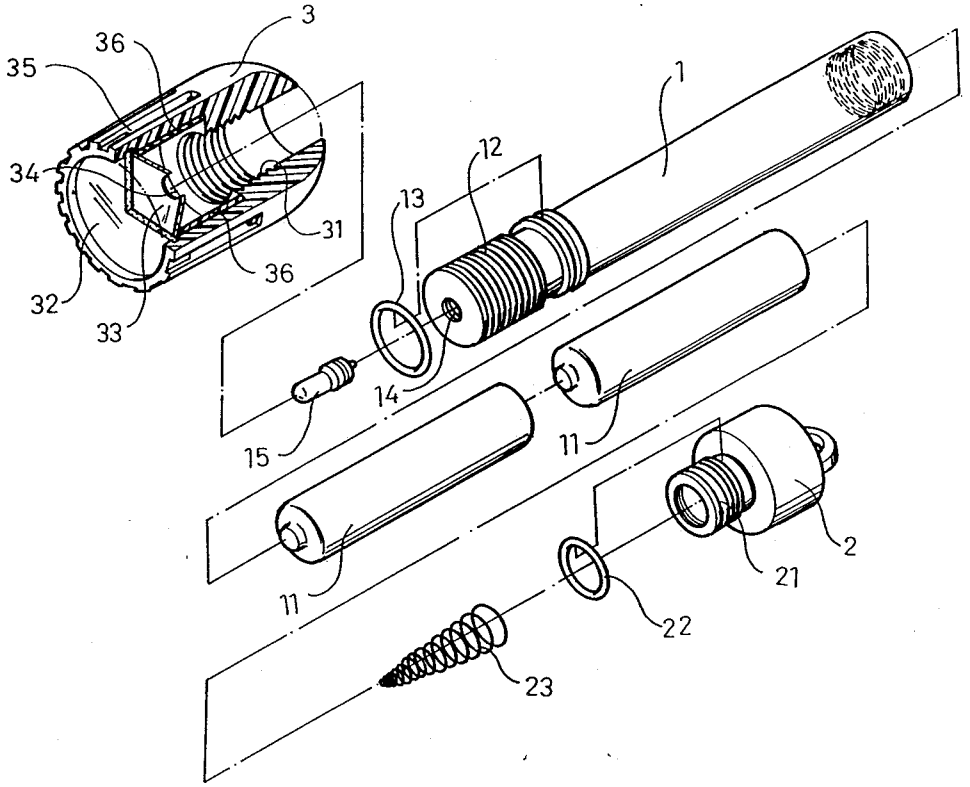
FIG. 1 is an exploded perspective view of the first embodiment of the warning & lighting flash light in the present invention.

The first embodiment of the warning & lighting flash light in the present invention, as FIG. 1 shows, comprises a cylindrical tube 1 made of electrically conductive material, a rear lid 2 of metal threadably mounted at the rear end of the tube 1, and dry cells 11 to be contained inside the tube 1. The rear lid 2 has a smaller diameter male-threaded portion 21, and an anti-leak gasket 22 is provided to fit around the portion 21, which has a hollow interior for a metal spring 23 to fit therein. The tube 1 has a male-threaded front portion 12 for a front cap 3 to combine threadably with, a screw hole 14 at the front end for a lamp 15 to screw with and an anti-leak gasket 13 fits around the tube 1.

The front cap 3 is made of an unconductive material, provided with a female thread 31 to screw with the male-threaded portion 12 of the tube 1, a lens 32 at the front and a cone-shaped reflective mirror 33 in the interior. The reflective mirror 33 has a central hole 34 for the lamp 15 at the front end of the tube 1 to extend through or retreat back. Besides, the front cap 3 has a circumferential light passing portion 35 covered with a red or blue colored fitler 36.

Figure 2:
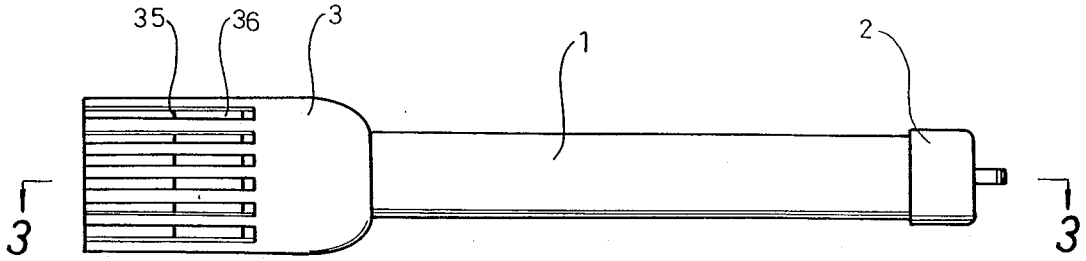
FIG. 2 is a front view of the first embodiment of the warning & lighting flash light in the present invention.
Figure 3:
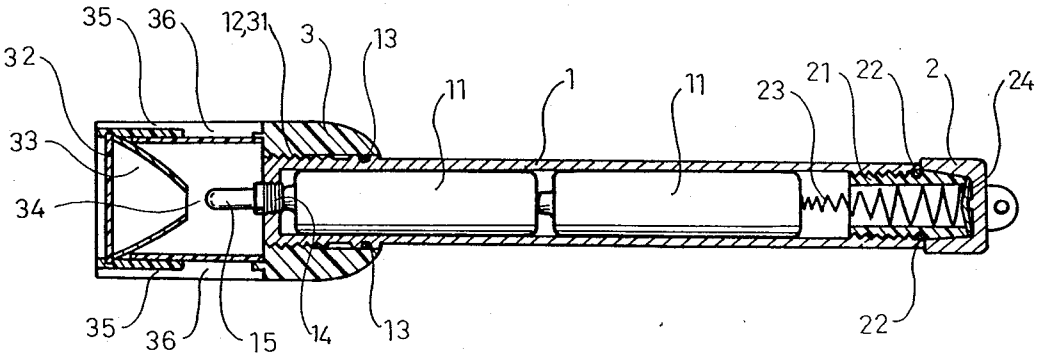
FIG. 3 is a cross-sectional view taken along line 3—3 of FIG. 2.

Next, referring to FIGS. 2 and 3, the rear lid 2 is not screwed tightly when this flash light is not in use — with some gap left between the lid 2 and the tube 1. Then the lamp 15 is impossible to be lighted as the current of the dry cells is interrupted by the gap. But if the rear lid 2 is tightly screwed with the tube 1, the lamp 15 can be lighted as the current from the cells can pass from the lid 2 to the tube 1 without the gap between them. In other words, the rear lid can function as a switch.

FIG. 3 shows the front cap 3 is loosely screwed with the front end of the tube 1, and the reflective mirror 33 is located behind the lamp 15 so that the light of the lamp 15 cannot be reflected but interrupted by the mirror 33 and can only shoot through the colored filter 36 and the light passing portion 35. Therefore, this flash light only functions as a warning tool or a traffic directing one.

Figure 4:
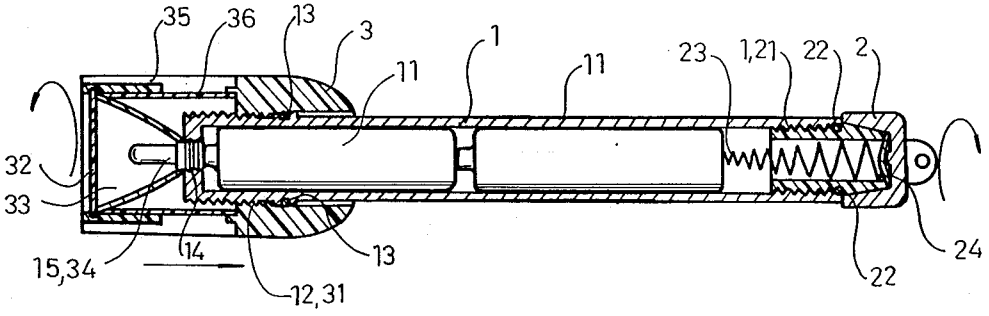
FIG. 4 is an actional view of FIG. 3.

When the front cap 3 is continuously screwed inward and tightly with the tube 1 as shown in FIG. 4, the lamp 15 protrudes forward through the hole in the mirror 33 and thereby is surrounded by the mirror 33, which can reflect the light of the lamp to brightly shoot forward to function as a common flash light. Then, the light passing portion 35 is screened by the wall of the tube 1 so that the lamp light can never go through it.

Figure 5:
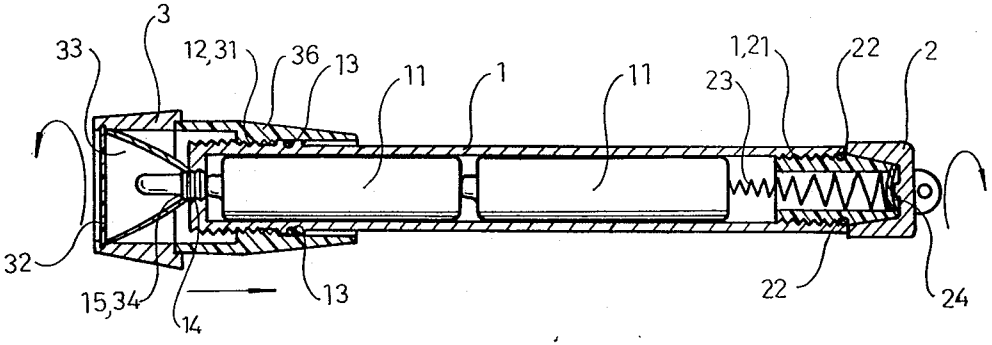
FIG. 5 is a cross-sectional view of the second embodiment of the warning & lighting flash light in the present invention.

FIG. 5 shows the second embodiment of this invention, wherein the front cap 3 has a colored filter 36 directly screwed with the male-threaded portion 12 of the tube 1, and thereby screwing the cap 3 in an adjusted distance can permit the lamp light reflected by the mirror 33 to shoot forward with the portion 35 covered by the wall of the tube 1 or interrupted by the mirror to shoot through the light passing portion 35 just as the first embodiment.

What is claimed is:

1. A warning & lighting flash light comprising;

a cylindrical tube made of a conductive material for containing dry cells and having a female-threaded rear end to screw with a smaller diameter male-threaded portion of a rear lid, the front end having a male-threaded portion for a front cap to screw with and a female-threaded portion for a lamp to screw with;

a rear lid having a smaller diameter male-threaded portion to screw with the female-threaded rear end of the tube, the male-threaded portion being unconductive and having a hollow interior for a metal spring to fit therein to urge dry cells and to contact with a conductive portion of the rear lid so that the electric current from the dry cells can be transmitted through the rear lid to the tube, the rear lid being adjustably rotated so that the conductive portion may be in contact with or separated from the tube to function as a switch;

a front cap having a female-threaded rear portion to screw with the male-threaded portion of the front end of the tube and a circumferential light passing portion at the middle section, a reflective mirror in the interior, the light passing portion being covered with a colored filter, and the reflective mirror having a central hole for the lamp to extend through or retreat back; and the front cap being possible to be rotated around the front end of the tube either deeply enough to make the central hole in the reflective mirror to be extended through by the lamp so that the light of the lamp can be reflected forward, or shallowly enough to position the reflective mirror in front of the lamp so that substantially all of the light of the lamp can be emitted through the light passing portion.

2. The warning & lighting flash light as claimed in claim 1, wherein the front cap can be rotated around the male-threaded portion of the front end of the tube moving inward such a distance that the light passing portion can be located near the lamp so that the light of the lamp can shoot only through the light passing portion or the lamp can be located extending forward through the central hole of the mirror and the light passing portion can be blocked by the wall of the tube.

* * * * *